United States Patent [19]

Andrews

[11] 4,166,236

[45] Aug. 28, 1979

[54] ELECTRIC ENERGY SAVING THREE-POSITION COMBINATION SWITCHING DEVICE

[76] Inventor: Peter Andrews, 190 Gebhardt Rd., Penfield, N.Y. 14526

[21] Appl. No.: 761,527

[22] Filed: Jan. 24, 1977

Related U.S. Application Data

[63] Continuation-in-part of Ser. No. 738,227, Nov. 1, 1976, and Ser. No. 442,082 Feb. 12, 1974, and Ser. No. 544,579, Jan. 27, 1975, abandoned, said Ser. No. 738,227 is a continuation-in-part of said Ser. No. 442,082, Pat. No. 4,005,334, Said Ser. No. 544,579 which is a continuation-in-part of said Ser. No. 442,082 and Ser. No. 250,949, May 8, 1972, abandoned, each is a continuation-in-part of Ser. No. 240,605, Apr. 3, 1972, abandoned, which is a continuation-in-part of Ser. No. 25,994, Apr. 6, 1970, abandoned.

[51] Int. Cl.[2] ..... H05B 39/04

[52] U.S. Cl. ..... 315/200 R; 200/298; 315/362; 315/DIG. 4; 307/146

[58] Field of Search ..... 315/71, 101, 200 R, 315/362, DIG. 4; 307/146; 200/153 L, 155 R, 298, 303

[56] References Cited

U.S. PATENT DOCUMENTS

| | | | |
|---|---|---|---|
| 2,723,327 | 11/1955 | Gilbert | 200/155 R |
| 2,896,125 | 7/1959 | Morton | 315/200 R |
| 3,037,146 | 5/1962 | Slater | 315/DIG. 4 |
| 3,215,891 | 11/1965 | Fritz et al. | 315/200 R |
| 3,748,532 | 7/1973 | Rosenbaum | 315/162 |

OTHER PUBLICATIONS

Sears, Roebuck Catalogue, Fall and Winter, 1969, Philadelphia, Pa., p. 820, Dimmer Control #4, Hi-Lo Cord Switch.

*Primary Examiner*—Eugene R. La Roche

[57] ABSTRACT

In one form of the present preferred embodiment of the present invention it relates to a three-position feed-thru electric line or wire cord piercing switching combination of the rotary type which at least saves electric energy by use of a half-wave diode rectifying means. The electric energy saving, three-position, combination switch having one "off" and two electrical passing switching positions. The switch will provide three-positions of 120 degrees for each position so that machine-gun or gunning, overshooting or rapid manual switch actuation for each of the three-positions is substantially prevented and also provides an electrical "off" half-wave rectified "dim" and an electrical full-wave "on" illumination to a single filament lamp, string of Christmas tree lamps and the like, and will even provide at least eight separate combination, of three illuminations, when electrically connected ahead of a, for example, conventional LEVITON rotary 3-way lamp socket switching means which uses a conventional 3-way incandescent lamp member which is removable inserted into the lamp socket portion thereof. The half-wave diode rectifying means is electrically connected to and substantially shuntingly between two of three electrical contact members of the conductor wire-piercing and the wire non-piercing type of switch.

19 Claims, 8 Drawing Figures

ELECTRIC ENERGY SAVING THREE-POSITION COMBINATION SWITCHING DEVICE

This application is a continuation-in-part of my copending applications Ser. Nos. 738,227 and 442,082 and 544,579 filed respectively Nov. 1, 1976 and Feb. 12, 1974 and Jan. 27, 1975. The Ser. No. 738,227 filed Nov. 1, 1976 is a continuation-in-part of my copending applications Ser. No. 442,082 filed Feb. 12, 1974, now U.S. Pat. No. 4,005,334, and Ser. No. 544,579 filed Jan. 27, 1975, abandoned, which is a continuation-in-part of my two copending applications Ser. No. 442,082 filed Feb. 12, 1974 and Ser. No. 250,949 filed May 8, 1972, abandoned, both of which were a continuation-in-part of my copending application Ser. No. 240,605 filed Apr. 3, 1972, abandoned, which was a continuation-in-part application of my copending application Ser. No. 25,994 filed Apr. 6, 1970, abandoned.

BACKGROUND OF THE COMBINATION INVENTION (1) Field of the combination invention A three-position, especially an electric line cord mounting type, switching means having a half-wave diode rectifier which is shuntingly electrically connected to two of the three electrical contacts of the switching means for providing a electrical "off", half-wave rectified "dim" and a full-wave "on" or an electrical "off", full-wave "on" and a half-wave rectified "dim" illumination to at least one electric incandescent lamp means when a person manually actuates a switch actuation exposed member portion thereof for at least switching the switch into its half-wave rectified "dim" position for at least saving money; extending the life of incandescent lamps especially when used with a photoelectric means and/or an electric lamp timer means so that at least a house will not be as easily burglarized and the like.

The electrical "off", half-wave "dim" and full-wave "on" switching sequence is preferred.

(2) Description of some of the prior art

Prior art electrical "on" and "off" miniaturized, for example, 2-position electrical conductor line cord switching means are well known by persons skilled in the art and are a commonly used household item which is basically electrically connected in a twin or parallel electric conductor wire that runs from a double-pronged male plug to an electric lamp fixture and the like. The miniaturized line cord switches, for example, are of the light duty type as, for example, a LEVITON "KWIK WIRE" miniature feed-thru cord switch of the line piercing type, that is sold under a stock number of 5669 by Sears, Roebuck, and Co. Other prior art two-position "on" and "off" line cord or line piercing type are J. M. LAPEYERE U.S. Pat. No. 2,802,083 which issued on Aug. 6, 1957 and Charles E. Gilbert U.S. Pat. No. 2,723,327 which issued Nov. 8, 1955 and even a rotary, push-button electric cord 4-position switching device was invented by F. D. Bryant et al on Mar. 26, 1940 being U.S. Pat. No. 2,195,237. A very old prior art which does not relate to a 2-position "off" and "on" switching line cord means, but will generally show how old the line cord, rheostat heat creating and electric energy wasting, dimming art is, is that of F. Emberger U.S. Pat. No. 1,273,754 which issued on July 23, 1918. Even a, 2-position "on" and "off", rocker type of line cord piercing switch was patented by Luis Ludwig on Sept. 5, 1972 being U.S. Pat. No. 3,689,723, but was totally silent and even a three-way switch having four positions which is used with a two filament lamp for providing an "off", "low", medium and high illumination to the three-way lamp was issued to F. D. Bryant et al U.S. Pat. No. 2,195,237 on Mar. 26, 1940 was also silent and even the lever actuated cord switch of J. G. Peterson U.S. Pat. No. 2,236,763 which issued on Apr. 1, 1941 as are all the disclosed prior art having any half-wave diode rectifying means, especially a silicon type, for saving electric energy, preventing some burglarizing by additional use of an electric utility timer and the like disclosed in the following objects of this invention and as to having only three lobes or cammed switching portions for providing a three-position switch thereby.

U.S. Pat. No. 3,689,723 discloses therein and thereby it need not be repeated in this specification as to the popularity and the after market "(in the home)" installation of line cord switches as well as prior art disadvantages and the like in column 1 and 2, and accordingly also relates to the disclosed Gilbert U.S. Pat. No. 2,723,327 therein.

SUMMARY OF THE INVENTION

A very important object of the electric energy saving invention is to provide a line cord switch which overcomes the foregoing generally disclosed disadvantages.

Another important object of the invention is to provide a line cord switch which constitutes relatively few and simple parts, is inexpensive to manufacture and is rugged, reliable and highly durable in use, especially when the housing of a LEVITON "KWIK WIRE" miniature feed-thru cord switch no. 5669 substantially need not be altered in any way when a half-wave diode rectifying means is housingly combined therewith for providing a cord mounted switch having electrical off-dim-on positions.

A still further very important object of the electric energy saving, and life extension of an incandescent lamp or even at least one filament member therein, extremely very simple combination invention is to additionally make an empty or generally unattended house more discouraging for burglars to enter by having at least one, two or even three separate lamps timingly illuminated in a half-wave dimmed state, by means of an electric utility timing means, by having one form of the invention, electrically connected in a line cord, that is interposed between the lamps having at least one illuminated half-wave "dimmed" filament therein and the electric timing means, thereby additionally saving money, electrical energy over one full-wave "on" illuminated lamp for creating a generally 30-1, fool-proof burned out lamp and a night darkened house thereby.

Another very important object of this invention, partly taken with the previous object, is to have the three-position switch having the diode rectifier in electrical connected combination therein and being in combination with the electric cord which leads to a switching portion of a, for example, 3-way LEVITON lamp socket of the key-switching type so that the low or medium or even both filaments of the lamp being half-wave "dimmed" when a utility timer is actuated for illuminating the lamp when the house is unoccupied, for at least discouraging burglars by having a 60-1 factor against bulb burnout and a darkened house, when the two filaments are "dimly" illuminated.

A still further important object, taken in-part with the above previous two objects, is to have a three-position toggle, rotary, push-push, lever and the like three-position combination switching means, having the diode in electrical connected combination therewith, electrically connected and substantially housed in the housing of the electric timer with the switching means being in the switch's half-wave "dimmed" position so that the filaments of the lamp will be timingly illuminated in a diode "dimmed" rectified state.

Another object of this three-position switching invention is to provide a substantially safety cover or guard for an otherwise exposed diametrical portion of a wheel member which generally protrudes from two side edge housing portions of the invention for preventing confusion and possible reversely forced manual rotation of the wheel member in that the resilient electrical contact members within the housing of the improved switch would be damaged and switch malfunction when the switch is accidently rotated 180 degrees with the cord member whereby the wheel member must be rotated in the opposite direction from that which a person was habitually used to.

Other and further objects may be made apparent as the following detailed description of the three-position electric energy saving switching means progresses at least to one skilled in the art.

DESCRIPTION OF THE PREFERRED EMBODIMENTS

Figure 1:
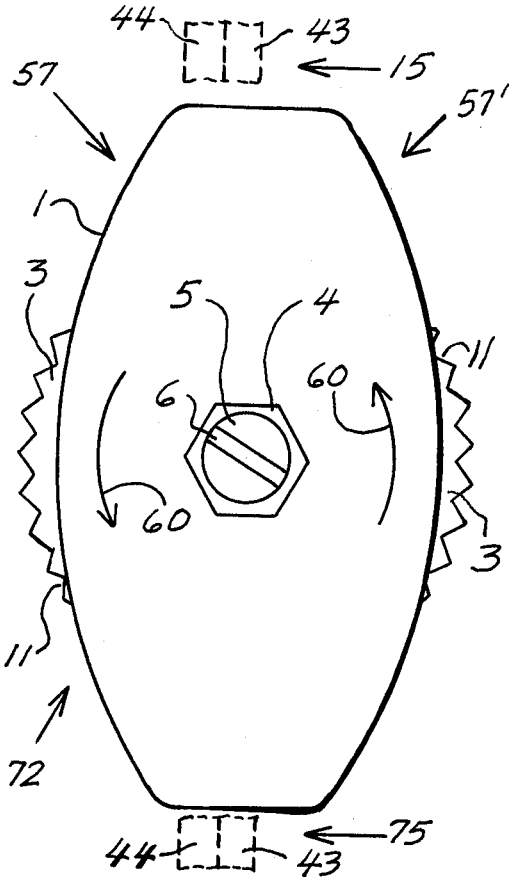
FIG. 1 is a top plan view of one of the various possible preferred embodiments of the, twin-wire electric cord or wire piercing, wheel actuating switch invention.
Figure 3:
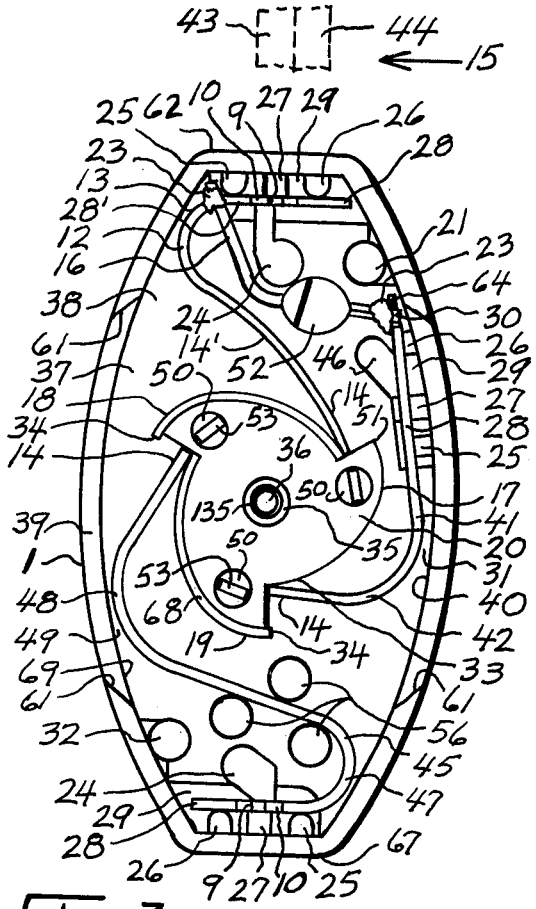
FIG. 3 is substantially a sectional view taken substantially along sectional line 2—2 of FIG. 2 with a cut-off portion of the switch actuation means therein to fully show one possible embodiment and arrangement of elements therein.

FIG. 1 shows the general shape of the burglar discouraging and electric energy saving three-position combination switching device 57 by arrow means. A generally conventional upper casing 1, conventional switch actuating wheel member 3 having serrations 11 on its outer diameter, hexagon opening 4, head of a metal screw means 5 having a screw driver slot 6 therein is also shown. A conventional metal nut (not shown) is preferred to be threaded onto the other end (not shown) of screw member 5, in the conventional way, for removably securing the device 57 onto twin-wire members 43 and 44 of a conventional electric cord member 15 which is shown by the dashed-line arrow means and which member 15 is generally shown in FIGS. 1 and 37 of copending application Ser. No. 442,082 and in FIG. 22 of Ser. No. 544,579 application. A threaded (not shown) end of screw means 5 may also be threaded or even self-threaded into opening 135 of a substantially matching center post 35 in the lower casing 2 portion as is generally shown in FIG. 3, whereby the conventional threaded nut member may be eliminated, if so desired. The direction of wheel 3 switching rotation is indicated by arrow means 60. Shown in dashed-line outline are electrical conductor wire members 43 and 44.

Figure 2:
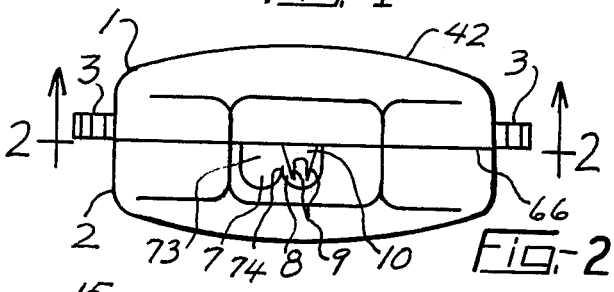
FIG. 2 is an end view of FIG. 1 switch invention showing the electric wire piercing points, and twin-wire opening thereof.
Figure 4:
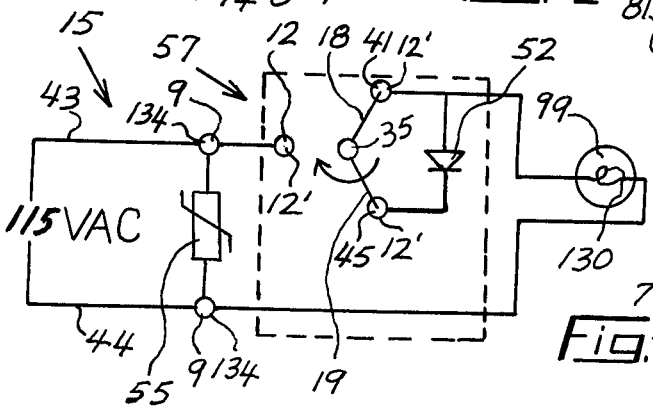
FIG. 4 is a partial improved schematic electric circuit combination emboding the three-position switching invention.

FIG. 2, end view of FIG. 1, shows the outer surface 42 of upper casing 1, generally conventional lower casing 2, sectional line 2—2, location of protruding portion of wheel member 3 in the upper casing 1 half-portion of device 57, the device's 57 generally half-casings 1 and 2 parting line 66, electrical conductor feed-thru twin-wire conventional partial openings 7 and 8 of opening 67 that are in each end portion of lower casing member 2 and a conventional electrical contact cord wire piercing tab-like member 10 having two electrical wire piercing prongs 9 integrally thereon. Opening 7 substantially houses or receives a longitudinal portion of a first electrical conductor wire member 44, of a conventional electrical twin-wire electrical cord member 15 which is shown by dashed line arrow means so that it can be fed through the lower casing 2 portion of device 57 and/or 57' and/or 72 in a conventional uncut way, as is generally shown in FIG. 4. Opening 8 substantially houses or receives a cut in-half and thereby separated second electrical conductor wire member 43, of the same conventional electrical twin-wire cord member 15, so that the cut and separated portions of wire member 43 can be electrically connected by two separated wire piercing tab-like members 10 by means of the wire piercing prongs 9, as is generally shown in FIG. 2 of U.S. Pat. No. 3,689,723 wherein conductor wire 27 is conventionally fed entirely through the casing 10 and the cut in-half conductor wire 26 is conventionally separated by an insulated wall portion of the casing 10, as is substantially in casing 2 or a LEVITON KWIK-WIRE MINIATURE FEED-THRU CORD SWITCH as sold by Sears, Roebuck and Co. by stock No. 5669. The casing 1, 2 and the wheel member 3 with its new improved integral three-lobed cam 20, shown in FIG. 3, are constructed or moulded from a conventional electrical insulating material known to persons skilled in the art. Elongated opening 73 may be formed without the pointed portion 74, if desired, whereby openings 7 and 8 would be eliminated.

FIG. 3 shows the general location and arrangement of the various elements which substantially are the heart of the combination invention or device 57.

The manually contacting and actuating portion of wheel member 3 is fragmentarily cut off so that at least the new three-lobed integral camming portion 20, which has on its (not shown) underside a new one-piece electrical conducting member which has two upwardly formed electrical conducting ear-like members 18 and 19 mounted on two separate lobed or cammed portions thereof, can readily be viewed and understood especially by persons skilled in the art.

The integrally connected (not shown) electrical contacts 18 and 19 are in their full-wave "on" electrical passing position by having the two integral electrical conducting resilient ends 14, of two electrical contact members 12 and 45, contacting thereon. Switch 57, for example, when cam 20 is rotated clockwise, from its shown resting position, the two separated ends 14 of contacts 12 and 45 wipingly slide along an outer surface of the clockwise moving contacts 18 and 19 until the outer end portions 14 of contact members 12 and 45 resiliently snap or trip off of the two separated outer ends 34 of members 18 and 19, thereby having the end 14 of contact member 45 rest against the insulated inner cammed surface portion 33 of the insulating cam 17. Thereby the improved combination device or switch 57 would be switched to its, first, electrical "off" first position. The half-wave diode rectifying means 52 has two of its electrical conducting wire leads 16 and 30 electrically connected by having their formed ends respectively soldered, spot welded, welded, and the like means 23, to the two separated integral generally stationary portions 28' of member 12 and 28 of member 41. Thereby when cam 20 is rotated another 120 degrees end 14 of contact member 12 will rest on the 33 portion of insulating cam 17, end 14 of contact member 45 will rest on electrical contact member 18 and end 14 of contact member 41 will rest on contact member 19 for illuminating at least one electrical incandescent lamp into a half-wave "dim" electrical energy saving and/or burglar discouraging state, and by merely using, for example, a ten cent (10¢) half-wave diode means 52 which is electrically connected to one end 28 of contact member 41 and one portion 28' of member 12. Switch 57 is thereby in its electrical passing, second, position.

It should be noted that the shown switch 57 is not made up of entirely conventional elements.

The three electrical resilient contact members 12, 41 and 45 are formed from a one-piece resilient electrical conducting material.

The switch 57 is generally one entity, as a whole, that also shows simplicity of an improved combination invention, in a very simple miniaturized form, for further providing the public with a very reliable, cheap, efficient, economical, convenient to mount three-position switch in a very facile way. Yet, switch 57 is also substantially miniaturized in size for pleasant unbulky mounted appeal to one's eye and also resulting in reduced energy cost for its manufacture as well as the reduced cost of the material used for its casing 1 and 2.

Referring back to FIG. 3 which shows two generally rear rigid bosses 25 and 26 and one generally forward boss 24. The three bosses 24, 25 and 26 substantially support the generally rigid non-moving integral portion 28 and 28' of members 12, 41 and 45 in a generally upstanding position on top of a preferred raised boss 29. The web-like boss 27 fits into a cutout (not shown) portion of member 12, and the boss 27 is used for accurately positioning member 12, 41 and 45 in cavity 37 in a conventional way. Shown is a curved 13, 42 and 48 resiliently moving portion of members 12, 41 and 45 respectively, curved end wall 61 of recess 39 which provides clearance for wheel 3 in casing 1 in a conventional way, half-wave diode rectifier means 52 which is of the preferred silicon glassivated (A14) and space permitting the (A15) type which is manufactured by General Electric Co., but other half-wave dioded of elongated tubular-like types of well known silicon diode and even the germanium type of rectifiers, to persons skilled in the art, may be used as desired or deemed necessary. However, the preferred glassivated diode 52 is of solid glass and provides passivation and protection of the silicon pellet's P-N junction. No organic material is present within the hermetically sealed package or diode 52 and the like advantages and of even having rigid mechanical support by its dual heat sink construction well known to persons skilled in the art. Also shown in FIG. 3 are two conventional upstanding pin-like members 21 and 32 which are used conventionally for accurately positioning the casings 1 and 2 together as is generally shown in FIGS. 1 and 2.

Further in FIG. 3 it shows the one-piece rotatable electric conducting switching contact member 68 having integrally formed up and curved ear-like contact members 18 and 19 and three formed up members 53 which are rotationally captively retained in openings 50. The curved portions 42 and 48 of the second and third contact members 41 and 45 respectively are shown spaced 31 and 49 from the inside wall portions 40 and 69 of casing 1 but one or both portions 42 and/or 45 may be against the inside wall portions 40 and 69 if so desired or deemed necessary for creating a generally balanced resilient switching snap-off action of their ends 14 as that of end 14 of the first contact member 12 from ends 34 and insulating end 51, especially since resilient contact members 41 and 45 must be much longer than member 12 in order to provide a very reliable, resilient, safe and positive electrical snap-off and contact means within the generally elongated and miniaturized switch 57.

The three upstanding bosses 56 generally support a long longitudinal resilient portion of member 45 so that at least a greater snap-off control and accuracy of its end 14 from an end 34 is obtained. However, one, two or all three bosses 56 may be eliminated if so desired or deemed necessary. The underside of member 68 also has an opening (not shown) which clears the diameter of screw 36 and which may be used for further aiding in the radial substantially captive attachment and positioning of member 68 onto the rotating insulating cam member 20. The underside of member 20 also having a protruding boss-like portion (not shown) which would fit into the above mentioned (not shown) opening in member 68 for additional radial captive attachment thereof, if desired, especially if the three openings 50 and the three tablike fingers 53 therein do not provide enough radial anchoring or captive means of member 68 to member 20. It has been found that the curved contacts 18 and 19 by themselves, being only 120 degrees apart, are insufficient to radially captively attach member 68 to member 20 in a good safe, strong and capitive way. An adhesive means and the like may also be used for adhesively securing member 68 to member 20 if so desired or deemed necessary.

The physical size of switch 56 and casings could readily be enlarged to the point that contacts 41 and 45 would be rearranged and also be the same one-piece conventional part as is contact 12 and its adjunct parts. The diameter of wheel member 3 would possibly have to be enlarged or changed accordingly. Thereby cam 20 would be the only new element or part of the combination but still being, in effect, combination switch 57 which would still not be composed of all old elements, if so desired, and being a still different embodiment of the electric energy saving invention.

The electrical contact member 41 is new and does not have the conventional tab-like member 10 having conventional wirepiercing prongs 9, as do contact members 12 and 45.

FIG. 4 shows one electrical circuit in which, the dashed-line outline indicated by arrow means, switch 57 may be used. It shows electric cord member 15; wires 43 and 44; varistor 54 having line piercing points 9; cam 20 pivoting member 35; contact members 12, 41 and 45; rotating contact members 18 and 19; mechanical, soldered, spot welded, welded and the like electrical connection means 12'; diode 52; incandescent lamp 9 having filament member 130; and the 115 VAC supply of electric current.

Figure 5:
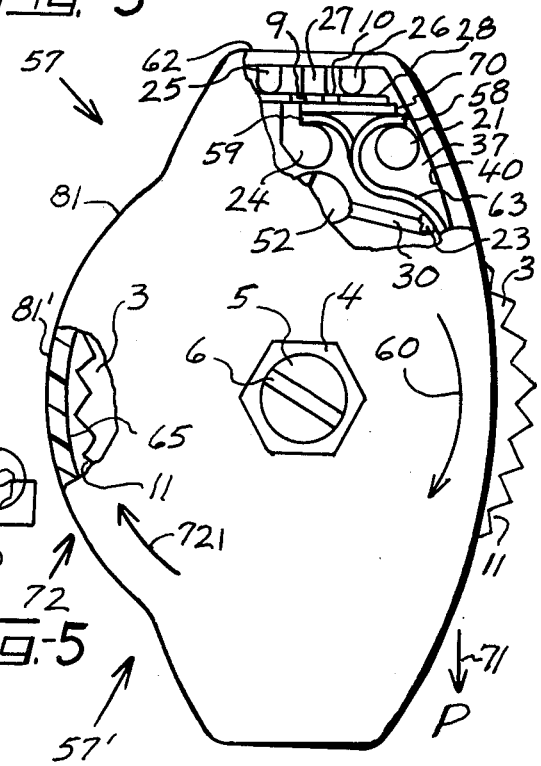
FIG. 5 is a improved housing of the invention having a switch rotation safety guard or bulging cover portion and showing two fragmentary cut away portions of the housing to show a new non-conventional method of anchoring one end of an electrical contact member of the invention and how the cover portion protects a diametrical portion of the wheel member for one-way habit-formed rotation thereof.

FIG. 5 shows a how a non-conventional electrical contact member 63 having non-conventional spring 63 anchoring ends 58 and 59 is to be used in place of contact member 41 of FIG. 3 for another embodiment of the switch 57. The conventional boss 24 and base of pin means 21 are also used. An electric insulating strip of material 70 is interposed substantially between the end 28 of contact member 12 and the substantially barbed ends 58 and 59 of member which is also formed from a resilient electrical conducting material. Diode 52 is partially shown and having its one wire lead member 30 electrically connected by soldering means 23 to a portion of member 63. Contact member 63 having a curved portion 42 and an end portion 14 as is shown on member 41 in FIG. 3. Contact members 12 and 45 and their integral adjunct portions 9, 10 and their conventional anchoring members 24, 25, 26 and the like are also used but not for member 63 as is for member 41. The three posts or bosses 56 are also not used, if so desired, nor is bulge 81 for creating switch 57 where not one structural portion of a conventional casing 1 and 2 of a LEVITON "KWIK WIRE" miniature feed-thru cord switch of the line piercing type need be changed in any way. The LEVITON switch is sold under a stock No. 5669 by Sears, Roebuck, and Co.

FIG. 5 is further in another embodiment of switch 57 being a cut-away fragmentary section of an altered matching embodiment portion of casings 1 and 2 of FIG. 3. The substantially safety cover or bulge 81 provides room for the rotation of wheel member 3 and extra room for the housing of the glassivated ball-like portion of diode 52 as desired or deemed necessary, while at the same time cavity 82 would substantially house or cover the otherwise protruding portion of wheel member 3 from that side edge portion as is generally shown in FIG. 37 of Ser. No. 442,082 application wherein bulge 36' is shown. Switch 57' being a different embodiment, in part, in that mechanical, soldering, spot welding, welding and the like conventional means for electrically connecting each cut end portions, of the cut in two portions of wire member 43, for example, soldered or welded to the prongs 9 or tab-like portion 10 of contact members 12 and 45 or for example, prongs 9 are eliminated and a conventional mechanical means is added to tab-like member 10 which may have a formed or extended portion thereof (not shown) added thereto to provide for the added mechanical means.

Additionally switch 57' represents a rotary rod-like manual actuating member type, rocker, toggle, slide, push-push, lever, Levolier, CHERRY, MICRO and the like three-position electric cord mounting and/or non-electric cord mounting switching means having an electrical "off", half-wave rectified "dim" and an "on" position.

The partial wheel 3 cover 81 also is, in effect, a one-way wheel 3 manually actuating safety feature in that a person, who is especially when a hurry or in a generally darkened room and/or who is familiar with the electrical switching direction of wheel 3, as is generally shown by arrow means 13, towards the electrical plug member 110 of FIG. 37 of Ser. No. 442,082 application, will also automatically rotate wheel 3 towards the electrical plug direction as is indicated by the arrow means 71 and the large letter P in FIG. 5 and in the direction of arrow means 60. This is because even a half portion of the extended cover 81 of casing 1 only will prevent a person from directly substantially reaching the outer serrations 11 of wheel 3, as is generally shown in FIG. 14 and substantially in FIG. 37 of Ser. No. 442,082. A person cannot accidently attempt to rotate wheel 3 in the direction of the arrow means 721. If the switch 57 is reversed 180 degrees from that showing in FIG. 5 then a person would have to rotate wheel 3 in the opposite direction of arrow means 60 in order to electrically actuate wheel 3 or switch 57. Cover 81 whether one-half on casing 1 only or in whole being one-half on casing 1 and another matching one-half on casing 2 or even an integral wheel 3 guard or band like member 81' only would also prevent a person from manually reversely forcing the cam 20 against a longitudinal resilient length of members 12, 41 and 45. A person may thereby possibly deform at least one of the resiliently shaped portions 13, 14' and 14 of at least one member 12 and ends 14 of members 41 and 45, rendering the switch 57 inoperable, especially when switch 57 and a portion of a twin-wire 43 and 44 electric cord member 15, which is shown in FIGS. 1 and 3, is unknowingly rotated 180 degrees from that which is shown in FIG. 1 where switch 57 has a serrated 11 portion of wheel 3 protruding from two sides thereof. When switch 57 is rotated 180 degrees from that shown in FIG. 1 then the arrow means 60 and 72 shown in FIG. 5 must also be reversed 180 degrees from that as shown in FIG. 5. A person must additionally remember this when a wheel 3 cover 81 and/or guard 81' is not substantially integral with casing 1 and/or casing 2. The arrow means 60 of FIG. 1 on both outside wall portions of casing 1 and 2 would also provide visible means for proper directional actuation of wheel 3 but not in a dark room or to a blind person especially if switch 57 is rotated 180 degrees from that which the blind person is acquainted with.

Prior art "LEVITON" twin electric cord wire non-piercing type of wheel electric switching means having a bulge 36' which is also shown in FIG. 37 of Ser. No. 442,082 application, is well known. However, the prior art bulge was for housing an insulated longitudinal uncut wire member of a twin-wire electric cord 15, for example. Not one portion of the switch actuating wheel was designed to be housed in the prior art bulge 36' to prevent two reversal actuations of wheel member 3. The prior art switch actuating wheel had to thereby be designed with a much smaller diameter and smaller adjunct switching members accordingly. The bulge 36' in FIG. 37 Ser. No. 442,082 was to provide room for the rotating wheel 35' while substantially housing or covering up a rotating and protruding portion of wheel member 35'.

Arrow means 72 further represents the FIG. 5 embodiment of cover 81 or guard 81' as being added to the switch 57 and/or switch 57' as desired.

Figure 6:
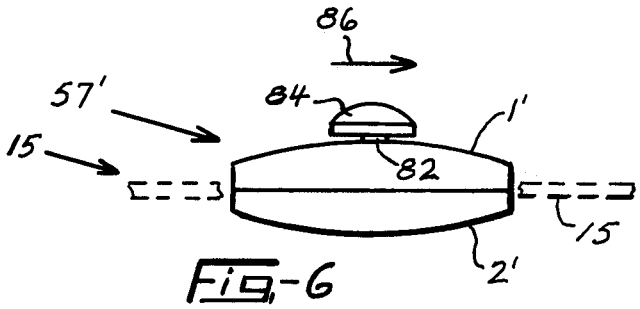
FIG. 6 is a side edge view of another embodiment of the 3-position switching invention showing an extended member, which may have a knob-like member thereon, as shown.
Figure 7:
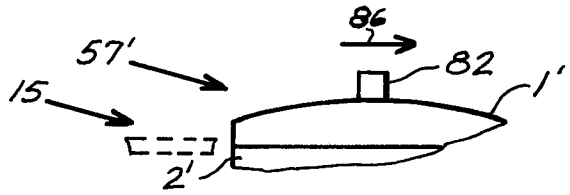
FIG. 7 is a partial cut-away side edge view of FIG. 6 showing the extended rotatable rod-like member without the knob-like member thereon.
Figure 8:
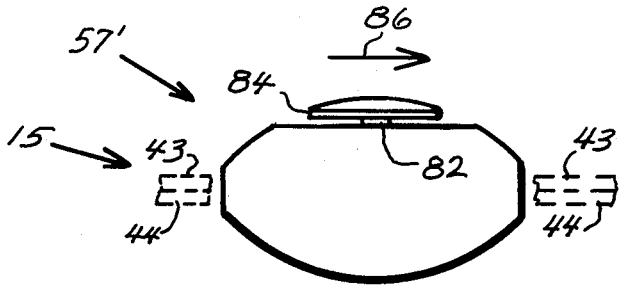
FIG. 8 is another embodiment of the 3-position switching invention also having a rotating knob-like member.

FIG. 6 shows the 57' embodiment disclosed previously inpart in this specification regarding the rotating rod-like member 82 which also may have the knob 84 thereon as shown, as is desired, for aiding in manual rotation of the rod-like member 82 and internal switching means within the casings 1' and 2' of embodiment 57'. Thereby when the rod-like member 82 is manually rotated, with or without use of knob 84, it will switchingly rotate the three cammed insulating member 20 and electrical contact members 18 and 19 thereon in the same way that the rotating wheel member 3, shown in FIGS. 1 and 5 embodiment, rotates member 20 when it is indirectly manually rotated.

Knob 84 and rotating rod-like member 82 is the same conventional type of rod-like member 18 and knob 4 fully disclosed in my copending application Ser. No. 738,227; 442,082; 544,579; 250,949; 240,605 and 25,994, the latter of which was filed June 6, 1970 and generally shows a rotating 13 rod-like member 18 and knob-like member 4 in the drawing FIGS. 4, 6, 7, 10 11, 13 and 14 thereof. The rod-like member 18 and knob-like member 4 are renumbered as 82 and 84 respectively in FIG. 6 of the drawing to this application.

In view of the foregoing it will be seen that the objects and advantages of the various disclosed embodiments of the three position electrical switching invention are obtained.

It will be understood that the invention is not to be limited to the exact constructions shown and described, but that various changes and modifications may be made without departing from the spirit and scope of the invention, as defined in the appended claims.

I claim:

1. An electric energy saving three-position electric switching device having an electrical "off", half-wave "dim" and full-wave "on" position for electrical connection to a two-conductor wire member of substantially an electric cord member, comprising in combination: an electric insulating housing having an upper casing portion and a lower casing portion for being juxtapositioningly mounted on said cord member; said upper casing portion having therein a one-piece first electrical contact member and a one-piece second electrical contact member and a one-piece third electrical contact member each of which having a free substantially end detenting portion thereof spaced substantially 120 degrees apart from each other and each of which is formed from a resilient electrical conducting material, said upper casing portion also having a half-wave diode electrical rectifying means, a one-piece rotatable electric current conducting contact member and a manually operable switch actuation means being substantially housed therein for manually operatively actuating a pivotly mounted rotatable member having an electric insulating switching portion integrally formed on substantially one end portion thereof; said switching portion having said contact conducting member substantially captively attached to at least one portion thereof for electrical switching rotation therewith so that when it is in its first switched electrical "off" position said conducting contact member is electrically connected to said first said contact member and siad second said contact member and when it is in its second switched half-wave electrical rectified "dim" position said conducting contact member is electrically connected to said second said contact member and said third said contact member and also having said rectifying means electrically connected to said first said contact member and said second said contact member and when it is in its third switched electrical full-wave "on" position said conducting contact member is electrically connected to said first said contact member and said third said contact member; said lower casing portion having a substantially channel-like opening entirely through two outer end wall portions thereof for removably and substantially receiving a longitudinal portion of said two-conductor wire member having a first wire member and a second wire member therein; said lower casing portion will substantially house therein one uncut said first wire member and said second wire member which has a first and a second cut and separated wire end portions; said first cut end portion will be electrically connected by an electric wire connecting means to a portion of said first said contact member, and said second cut end portion will be electrically connected by an electrical wire connecting means to a portion of said third said contact member; said electric three-position switching device is so constructed and arranged that when it is electrically connected and mounted substantially on said cord member an electrical half-wave rectified "dim" electric energy saving illumination to at least one filament member of at least one electric incandescent lamp is thereby obtained and also thereby for discouraging burglars from entering an electrically half-wave rectified "dim" illuminated house since said lamp has a substantially 30-1 burn out factor against a full-wave "on" illuminated said lamp and substantially a 30-1 burn out factor at generally twice the illumination of a single filament dimmed member when two filaments of a 3-way said lamp are in their electrical half-wave rectified "dim" illuminated state and also if an electric utility timer means is used in electrical connected combination with said device when a house is unattended at night and especially when a person is on vacation.

2. In the combination of claim 1 wherein said switch actuation means being a rotatable wheel member means.

3. In the combination of claim 2 wherein said wheel member means having serrations on its outer diameter portion.

4. In the combination of claim 2 wherein said upper casing portion having an integral guard-like member on one side edge portion thereof for substantially protecting and preventing a protruding outer diameter portion of said wheel member from being manually forcingly reversely rotated and thereby damaging said first said second and said third said contact members especially after repeated forced reversal rotation thereof to the point that said switching device malfunctions from said edge portion thereof when said switching device is removably mounted on said two-conductor wire member.

5. In the combination of claim 2 wherein said upper casing member having an integral half-cover portion on one side edge portion thereof for substantially preventing a protruding outer diameter portion of said wheel member from being accidently manually rotated from said side edge portion of said upper casing member to the point that said first and said second and said third said contact member are damaged causing said switching device to malfunction when said switching device is removably mounted on said two-conductor wire member and accidently substantially rotated one hundred and eighty degrees together with a longitudinal portion of said two-conductor wire member.

6. In the combination of claim 5 wherein said lower casing members having an integral half-cover portion which is matchingly formed to at least one outer shaped edge portion of said half-cover portion on said upper casing when said upper and lower casing members are juxtapositioned and removably mounted on said two-conductor wire member.

7. In the combination of claim 1 wherein said switch actuation means being a rod-like member means which extends axially and transversely through an outer face edge portion of said lower casing member.

8. In the combination of claim 7 wherein said rod-like member means having a knob-like member means thereon for indirectly more conveniently and easily manually switchingly rotating said conducting contact member.

9. In the combination of claim 1 wherein said lower casing member having an integral partition portion means which is interposed between said first ans said second cut and separated wire end portions for insulatingly preventing at least one said separated wire end portions from being electrically substantially reconnected.

10. In the combination of claim 1 wherein said wire connecting means being an integral electric wire insulation-piercing points of said first and third said contact member that also pierces at least one wire member of said first and said second cut and separated wire end portions for making electrical contact therewith.

11. In the combination of claim 1 wherein said wire connecting means being integral electric wire piercing points of said first and said third said contact member; said points are electrically connected to said first and said second said wire end portions by being soldered to at least one electric current conducting wire portion of said first and said second said wire end portions.

12. In the combination of claim 1 wherein said wire connecting means being a spot welded connecting means to at least one electric current conducting wire portion of said first and said second said wire end portions.

13. In the combination of claim 1 wherein said wire connecting means being an integral tab-like member of said first and said third said contact member; said tab-like member being electrically connected to said first and a said second said wire end portions by being soldered to at least one electric current conducting wire portion of said first and said second said wire end portions.

14. In the combination of claim 1 wherein said wire connection means being an integral tab-like member, having an opening through one portion thereof, of said first and said third said contact member; said tab-like member being electrically connected to said first and said third said wire end portions by being mechanically connected to at least one electric current conducting wire portion of said first and said second said wire end portions by use of a headed screw means which is threaded into said opening of said tab-like member while having a longitudinal portion of said first and said second said wire end portions between said headed portion of said screw means and a face portion of said tab-like member.

15. In the combination of claim 1 wherein said switching device is removably mounted substantially on said cord member by use of one threaded means.

16. In the combination of claim 15 wherein said switching device is removably mounted substantially on said cord member by use of one threaded screw and nut means.

17. In the combination of claim 1 wherein said switching device is mounted substantially on said cord member by use of one rivet means.

18. In the combination of claim 1 wherein said rectifying means is electrically connected to said second said contact member and said third said contact member for providing an electrical "off", full-wave "on" and a half-wave "dim" position for each revolution of said electric insulating switching portion having said conducting member substantially captively attached to at least one portion thereof.

19. An electric energy saving three-position electric switching device having an electrical "off", half-wave "dim" and full-wave "on" position for electrical connection to a two-conductor wire member of substantially an electric cord member, comprising in combination: an electric insulating housing having an upper casing portion and a lower casing portion for being juxtapositioningly mounted on said cord member; said upper casing portion having therein a one-piece first electrical contact member and a one-piece second electrical contact member and a one-piece third electrical contact member each of which having a free substantially end detenting portion thereof spaced substantially 120 degrees apart from each other and each of which is formed from a resilient electrical conducting material, said upper casing portion also having a half-wave diode electrical rectifying means, a one-piece rotatable electric current conducting contact member and a manually operable switch actuation means being substantially housed therein for manually operatively actuating a pivotly mounted rotatable member having an electric insulating switching portion integrally formed on substantially one end portion thereof; said contact switching portion having said conducting member substantially captively attached to at least one portion thereof for electrical switching rotation therewith so that when it is in its first switched electrical "off" position said conducting contact member is electrically connected to said first said contact member and said second said contact member and when it is in its second switched half-wave electrical rectified "dim" position said conducting contact member is electrically connected to said second said contact member and said third said contact member and also having said rectifying means electrically connected to said first said contact member and said second said contact member and when it is in its third switched electrical full-wave "on" position said conducting contact member is electrically connected to said first said contact member and said third said contact member; said lower casing portion having a substantially channel-like opening entirely through two outer end wall portions thereof for removably and substantially receiving a longitudinal portion of said two-conductor wire member having a first wire member and a second wire member therein; said lower casing portion will substantially house therein one uncut said first wire member and said second wire member which has a first and a second cut and separated wire end portions; said first cut end portion will be electrically connected by an electric wire connecting means to a portion of said first said contact member, and said second cut end portion will be electrically connected by an electrical wire connecting means to a portion of said third said contact member; said electric three-position switching device is so constructed and arranged that when it is electrically connected and mounted substantially on said cord member an electrical half-wave rectified "dim" electric energy saving illumination to at least one filament member of at least one electric incandescent lamp is thereby obtained and also substantially preventing machine-gun-switching by manual actuation of said switch actuation means.

* * * * *